US011885326B2

(12) United States Patent
Drysdale

(10) Patent No.: US 11,885,326 B2
(45) Date of Patent: Jan. 30, 2024

(54) FLEXIBLE IMPELLER PUMP

(71) Applicant: MARINE FLOW LIMITED, Tillicoultry Central Scotland (GB)

(72) Inventor: Stuart Drysdale, Tillicoultry (GB)

(73) Assignee: MARINE FLOW LIMITED, Tillicoultry Central (GB)

( * ) Notice: Subject to any disclaimer, the term of this patent is extended or adjusted under 35 U.S.C. 154(b) by 0 days.

(21) Appl. No.: 15/320,138

(22) PCT Filed: Jun. 22, 2015

(86) PCT No.: PCT/GB2015/051810
§ 371 (c)(1),
(2) Date: Dec. 19, 2016

(87) PCT Pub. No.: WO2015/193691
PCT Pub. Date: Dec. 23, 2015

(65) Prior Publication Data

US 2017/0130715 A1 May 11, 2017

(30) Foreign Application Priority Data

Jun. 20, 2014 (GB) ..... 1410986

(51) Int. Cl.
*F04C 15/00* (2006.01)
*F04C 5/00* (2006.01)
*F04C 29/00* (2006.01)

(52) U.S. Cl.
CPC ..... *F04C 15/0076* (2013.01); *F04C 5/00* (2013.01); *F04C 15/0007* (2013.01); *F04C 15/0073* (2013.01); *F04C 29/0071* (2013.01); *F04C 29/0078* (2013.01); *F04C 2230/70* (2013.01)

(58) Field of Classification Search
CPC .... F04C 29/0078; F04C 15/0076; F04C 5/00; F04C 2230/604; F04C 2230/70; F04C 2230/80; F04C 2230/85; F04C 2240/605; F04C 29/0071; F04C 15/0073; F04C 15/0007; F04D 29/382; F04D 29/263; F04D 29/266; F04D 29/20; Y10T 29/49236; Y10T 29/49238; Y10T 29/49248; Y10T 29/49316; Y10T 29/49318; Y10T 29/37; Y10T 29/53796; Y10T 29/53848
See application file for complete search history.

(56) References Cited

U.S. PATENT DOCUMENTS 2,712,792 A * 7/1955 Snyder ..... F04C 5/00 418/154
2,911,920 A 11/1959 Thompson
(Continued)

FOREIGN PATENT DOCUMENTS

CH 459767 7/1968
EP 1447564 3/2006
(Continued)

*Primary Examiner* — Bryan M Lettman
(74) *Attorney, Agent, or Firm* — Dickinson Wright PLLC

(57) ABSTRACT

A mounting hub operable to connect a flexible impeller to a drive shaft. The mounting hub is detachable from the impeller, and is adapted to permit the impeller to be decoupled rotationally from the impeller drive shaft during installation, and then recoupled rotationally once the flexible impeller is in position.

15 Claims, 5 Drawing Sheets

(56) References Cited

U.S. PATENT DOCUMENTS 4,340,317 A * 7/1982 Heitmann ..... F01D 5/025 403/25
4,375,926 A * 3/1983 Feller ..... F16D 1/092 403/15
4,592,733 A * 6/1986 Bland ..... F04C 15/0073 440/88 P
4,718,837 A 1/1988 Frazzell
5,660,536 A 8/1997 Karls et al.
6,116,855 A * 9/2000 Maki ..... F04C 5/00 29/264
6,213,740 B1 * 4/2001 Barnes ..... F04C 5/00 418/2
6,394,753 B1 * 5/2002 Maki ..... F04C 2/44 29/267
6,398,522 B2 6/2002 Skill
7,008,187 B2 3/2006 Cazzaniga
8,157,510 B2 * 4/2012 Bear ..... F04C 5/00 415/141
2009/0081044 A1 * 3/2009 Corcoran ..... F16D 1/108 416/204 A
2011/0146044 A1 * 6/2011 Pecherzewski ..... B25B 27/00 29/278
2016/0032926 A1 * 2/2016 Moeser ..... F04C 25/02 417/410.3

FOREIGN PATENT DOCUMENTS

EP 2333236 6/2011
FR 1307316 9/1962
GB 672522 5/1952
GB 870662 6/1961
GB 2115489 9/1983
GB 2407847 8/2007
WO 2009054961 4/2009
WO WO2014086338 * 6/2014

* cited by examiner

FLEXIBLE IMPELLER PUMP

CROSS-REFERENCE TO RELATED APPLICATIONS

The present application is a 35 U.S.C. Section 371 national stage filing of International Patent Application No. PCT/GB2015/051810, filed 22 Jun. 2015, and through which priority is claimed to GB Patent Application 1410986.2, filed 20 Jun. 2014, the disclosures of which are incorporated herein by reference in their entireties.

FIELD OF THE INVENTION

The present invention relates to flexible impeller pumps. In particular the present invention relates to a flexible impeller having a novel vane configuration, and a pump including such an impeller. In addition the present invention relates to a mounting system for flexible impeller pumps.

BACKGROUND TO THE INVENTION

A flexible impeller pump is a well-known form of pump, which combines the priming feature of a positive displacement pump with the fluid transfer ability of a centrifugal pump. A flexible impeller pump is a self-priming pump, which comprises a generally cylindrical housing typically with a single cammed surface, or cam. The housing comprises an inlet and an outlet, both of which are associated with the cam. A flexible impeller having flexible radial vanes is mounted on a rotatable drive shaft; the impeller is typically secured using splines or a key, thus rotationally coupling the impeller to the shaft. The rotating flexible vanes are received within the housing, and form a sealing contact with the walls of the housing. Upon rotation of the impeller, the vanes bend when they make contact with the cam. The vanes are deflected when they make contact with the cam and this creates an increase in pressure, thus 'squeezing' the fluid being pumped out of the pump housing and out of the outlet. As the vanes pass over the cam, the deflection of the vanes is relaxed, which creates a vacuum with respect to the inlet, thus drawing fluid into the pump. The cooperation of the cam and the rotating vanes act to draw fluid into the housing from the fluid inlet and expel it through the outlet, and the continuous rotation of the flexible impeller thus carries liquid through the housing from the inlet to the outlet. These details of a flexible impeller pump and its operation are well known to the skilled person.

Dual-cam flexible impeller pumps, i.e. those having two cammed surfaces and two pairs of corresponding inlets and outlets have been proposed, but have not been successfully implemented to date. This is, at least in part, because of challenges in obtaining a suitable operating pressure from a dual-cam flexible impeller pump without slippage occurring. Slippage occurs when fluid slips past the pumping mechanism back to the inlet, e.g. because the pressure/head overcomes the seal between the impeller vane and the pump housing. One advantage of a dual-cam flexible impeller pump is that the capacity of the pump can be essentially doubled for the same size of pump.

Another advantage of the dual cam flexible impeller pump identified by the present inventor, is that, by having two diametrically opposed cams and hence inlets and outlets, the loading on the impeller drive shaft can be balanced. This is important in preventing excessive wear on bearing and seals, and on preventing fatigue and failure of the drive shaft. As will be appreciated by the skilled person, having a single cam produces an asymmetric load on the drive shaft caused by the reaction force of the vanes being deflected by the cam and the pumping pressure exerted against the impeller in the region of the outlet port.

The present invention provides improved flexible impellers and associated components which are particularly advantageous in the context of dual cam flexible impeller pumps, but which may also have utility in single cam flexible impeller pumps.

SUMMARY OF THE INVENTION

A first aspect of the present invention provides a flexible impeller comprising a body and a plurality of vanes extending outwardly from the body, wherein each vane comprises a root and a tip and at least two sealing elements.

The body is typically cylindrical, and the vanes extend substantially longitudinally along the cylinder, parallel to the axis of the cylinder. However, it will be appreciated that in some cases the vanes can be helically or otherwise disposed about the cylindrical body for some or all of their length. The flexible impeller is, of course, adapted for rotation within a corresponding pump housing.

Suitably the vanes extend substantially radially from the body of the impeller when in a relaxed state, i.e. when the impeller is not mounted in a pump housing and the vanes are not compressed against the inner surface of the housing. The term 'substantially radially' is intended to mean that the vanes extend outwardly in a generally radial fashion, but can be tilted relative to the exact radial angle by a given angle, either in the direction of rotation or counter to the direction of rotation; for example the vanes can be tilted by up to about 30 degrees from the true radial angle, typically up to about 20 degrees, and preferably up to about 10 degrees.

A 'sealing element' is typically an elongate surface of a vane, which, in use, abuts against the inner surface of the pump housing, thus creating a seal with the inner surface of the housing. This seal acts to isolate the fluid in on inter-vane volume from the fluid in the adjacent inter-vane volumes. In a conventional flexible impeller there is a single sealing element, which is typically defined by the tip of the vane.

The present invention is thus concerned with an impeller that is adapted so that there are two sealing elements, which are configured such that, when the vane contacts the cammed surface of the pump housing and is deflected, both sealing elements are brought into sealing contact with the cammed surface.

This provides significant advantages. Most notably, the circumferential distance between the pump inlet and outlet can be minimised. It will be appreciated that there must be a seal between the inlet and the outlet, to prevent slippage, i.e. leaking from the outlet (at high pressure) to the inlet (at low pressure). This seal is generated by the vane (or vanes) which lie between the outlet and inlet. Maintaining an adequate seal becomes a particular problem where the inlet and outlet are located in close circumferential proximity—this is particularly desirable in the case of a dual cam flexible impeller pump in order to maximise the number of vanes available for generating and maintaining pumping pressure, as will be explained in more detail below.

A first seal element may suitably be provided at the tip of the vane and a second seal element may be provided between the tip and the root of the vane.

It is convenient at this point to define a typical vane as having:

- a tip, which is the outermost point of the vane when not deflected, a root, which is the base of the vane where it meets the impeller body; and a stem, which is the elongate portion between the root and the tip.

The first seal element may simply be the convex tip of the vane, or it may comprise a specifically designed profile. For example, it is known to provide a rounded, bulbous tip on the vane to ensure a consistent sealing interaction between the tip and the housing surface both when the vane is in contact with the cammed surface, and when it contacts the remainder of the cylindrical inner surface of the pump housing.

The second seal element may suitably comprise a protrusion relative to the remainder of the vane. The protrusion can protrude from one or both sides of the vane. In the case of a pump which is designed to operate in two directions, i.e. where the impeller can rotate, and thus pump fluid, in both forwards and backwards, the protrusion would typically protrude from both sides of the vane. Where only a single direction of operation is intended, the protrusion will typically only protrude from one side of the vane, i.e. the side which is proximal to the cammed surface when the vane is deflected—this is typically the leading side of the vane. However, it will be appreciated that these are general guides, and a unidirectional pump may have a protrusion from both sides of the vane, or vice versa.

The second seal element is operable, in use, to contact the cammed surface of the pump housing and thereby provide a second sealing interaction between a single vane and the cammed surface of the housing.

The profile of the first and/or second sealing element may take any suitable form. For example, either profile could define an elongate lip or could define an elongate bulbous, e.g. convex, protrusion.

Suitably the root of the vane is of a suitable stiffness to ensure that flexing of the vane occurs at a desired point to ensure both the first and second sealing elements are engage with the pump housing when the vane is deflected by the cammed surface.

The specific dimensions of the impeller body and vanes can, of course, be optimised by the skilled person for any given pump. However, in the case of a dual cam flexible impeller pump, typically the vanes are optimised such that the distance between each vane is minimised, to thus maximise the number of vanes resisting the pressure gradient between the inlet and outlet. It will be appreciated that shorter vanes are typically stiffer, and thus better suited to resisting backpressure, than longer vanes. However, a limiting factor on the minimum length of the vanes is that they must be long enough such that they can deflect and successfully pass the cam during rotation. Likewise, vanes that are too thick will not readily deflect, and thus would not function well.

Preferably the pump is adapted such that it can pump (i.e. have a capacity of) at least 500 litres/min, more preferably at least 700 litres/min, and more preferably at least 800 litres/min.

Preferably the pump is adapted such that it can pump at a pressure of at least 1.5 bar, more preferably at least 2 bar, and preferably at least 2.2 bar at any of the pumping capacities mentioned above.

In a preferred embodiment the impeller is adapted such that when the vanes are deflected at the cammed surface, first sealing element (tip) and second sealing of a first vane and the first sealing element (tip) of a second vane are substantially circumferentially equidistant. Thus, the angular distance between successive sealing elements when engaged with the midpoint of the cammed surface is substantially constant. This ensures that there is a constant amount of sealing between the inlet and outlet arranged at the cammed surface In a preferred embodiment of the present invention, the impeller body is provided with an interface to engage with a fitting tool used during insertion of the hub into the pump housing. For example, the impeller body may comprise a plurality of slots or bores adapted to engage with protrusions on a corresponding fitting tool. Preferably the interface is adapted to allow rotation of the impeller body relative to the housing during insertion.

A second aspect of the present invention provides a single or multiple cam flexible impeller pump comprising an impeller according to the first aspect of the present invention.

Preferably the pump is a dual cam flexible impeller pump.

A dual cam flexible impeller pump comprises a pair of corresponding inlets and outlets, each corresponding inlet and outlet typically being substantially diametrically opposed, and two cammed surfaces associated with the inlets and outlets.

In more detail, a dual cam flexible impeller pump comprises a first inlet and corresponding first outlet, and a second inlet and a corresponding second outlet, wherein, in use, the impeller pumps fluid from the first inlet to the first outlet, and from the second inlet to the second outlet. Cammed surfaces are associated with the inlets and outlets, to provide the pumping effect, as required by the principles of a flexible pump. One cammed surface is associated with the first inlet and second outlet, and another cammed surface is associated with the first outlet and the second inlet. The cammed surfaces are substantially diametrically opposed.

Thus a dual cam flexible impeller pump comprises two 'pumps' in a single housing, each provided in a 180-degree arc of the cylindrical housing.

It will be apparent that there must be a seal separating each inlet from each outlet to prevent slippage, and this seal is provided by the vanes of the flexible impeller. The vanes operate in different manners at different points during the rotation of the impeller. As the vanes move from an inlet to the corresponding outlet (e.g. first inlet to first outlet), the vanes are in an extended conformation, and carry the fluid being pumped in the space between the vanes to the cammed surface at the outlet—these vanes can suitably be named 'pumping vanes'. The first sealing element of the pumping vanes creates a seal against the cylindrical inner surface of the housing. At the outlet the rotating pumping vanes are urged against the cammed surface and are deflected, and an increase in pressure is achieved by the reduction of volume caused by the cammed surface. Prevention of slippage of fluid as a result of the pressure gradient between the outlet and corresponding inlet (e.g. first outlet and first inlet) is prevented by the plurality of pumping vanes disposed between the outlet and the inlet and their sealing interaction with the cylindrical housing surface. It is therefore clearly important that the number of pumping vanes is maximised, or at least is sufficient to generate the operation pressure; the overall resistance to back pressure and slippage is proportional to the number of pumping vanes. In the case of a single cam flexible impeller pump this is not generally problematic, but in the case of a dual cam flexible impeller pump it will be appreciated that there is a much more limited area of housing surface between an inlet and its corresponding outlet for the pumping vanes to contact, and therefore fewer pumping vanes are available to resist the back pressure.

Another vital sealing operation occurs between the vanes and the cammed surface between the first inlet and second outlet, and the second inlet and first outlet. In this period of the pumping cycle, the vanes can be referred to as 'deflected vanes'. Again, sufficient sealing must be achieved to prevent slippage, this time between the second outlet and first inlet, and the first outlet and second inlet. In the case of deflected vanes the sealing action and ability to resist pressure of any single vane is much greater than for pumping vanes, and the deflected vanes press firmly against the cam surface as a reaction against their deflection. Furthermore, the pressure gradient between the first inlet and second outlet, and the second inlet and first outlet serves to press the deflected vane even more firmly against the cammed surface. Thus fewer deflected vanes than pumping vanes are required for an effective seal to be maintained at the cammed surface and prevent slippage.

In a dual cam flexible impeller pump (or indeed any multi-cammed flexible impeller pump), the present inventor has realised, there is a significant challenge in achieving suitable sealing by the deflected vanes while maintaining enough pumping vanes to pump the fluid at sufficient pressure. This problem is particularly acute in situations where it is desirable to minimise the physical size of the pump, and the diameter of the impeller. It will be appreciated that in a twin can flexible impeller pump, a single cylindrical housing hosts two pumping actions, and thus only half of the circumference of the pump housing is available to host an inlet, an outlet, and the necessary sealing surfaces.

To maintain a sufficient seal by the deflected vanes, it is conventionally necessary to have a significant circumferential distance of the cammed surface (cammed sealing area) available to engage with a plurality of deflected veins, typically at least two vanes. However, by having a relatively large cammed sealing surface, the circumferential distance between an inlet and its corresponding outlet available for pumping vanes to engage with is thereby reduced.

The present invention allows for a significant reduction in the size of the cammed sealing surface, thus allowing for more pumping vanes to be engaged with the inner surface of the pump housing, and thus allowing for an increase in maximum pumping pressure.

As discussed above, each vane has two sealing elements, and these are adapted such that when the vanes are deflected by the cammed surface, each vane is able to provide two separate, (typically, but not necessarily, parallel), sealing interfaces with the cammed sealing surface. This effectively allows the cammed sealing surface area to be reduced to approximately half the size of that present in a conventional flexible impeller pump, i.e. the angular distance occupied by the cammed sealing surface can be reduced by a half. This in turn allows for a corresponding increase in the angular distance around the housing which is available for sealing engagement with the pumping vanes. In the case of a dual cammed pump, this reduction in cammed sealing surface is present at both cams, which results in a significant improvement of sealing activity. Typically this allows for at least one, and in some cases two, additional pumping vanes to be disposed between an outlet and its corresponding inlet, thus increasing the maximum pumping pressure considerably.

The pump can be, for example, a cooling pump, a bilge pump, a wash down pump, a pump for food or drink, a pump for petrochemicals or a general utility pump. In a preferred embodiment the pump is a water pump. In a particular preferred embodiment the pump is a raw water cooling pump for an internal combustion engine. Dual cam pumps according to the present invention are of particular interest where there is a need to minimise the size of a pump for a given capacity. For example, in the case of diesel engines, such as marine diesel engines, space and particularly the pumps length or protrusion from the engine is often a significant constraint, and the pumps of a present invention allow for a large pumping capacity for a small physical size. Furthermore, the balance of forces on the drive shaft of a dual cam pump according to the present invention reduces the likelihood of shaft breakage, seal and bearing failure in operation, increasing the reliability of the pump during its service life A third aspect of the present invention provides a mounting hub operable to connect a flexible impeller to a drive shaft.

In practice fitting of a replacement impeller is a significant challenge given the context in which such pumps are used. A typical application for a flexible impeller pump is as a coolant pump for a marine internal combustion engine, e.g. a marine diesel engine. In such a context seawater is pumped past heat exchangers to cool the engine. In this case the running speed of the coolant pump is dictated by the available power take off from the engine, and is in many cases driven from the crankshaft.

This creates particular challenges, particularly for replacing impellers, e.g. when they become worn or during routine maintenance (typically at least once per year). It is typically impossible to rotate the impeller drive shaft as it is mechanically linked to the static engine crankshaft. When inserting a replacement impeller it will be appreciated that the foremost edge of the vanes of the impeller (when being inserted) will abut against, and thus snag on, various parts of the pump housing, for example the vanes will catch against the entrance to the pump housing, the edges of the cammed surfaces, the edges of the inlets and outlets, and any circumferential support ribs provided in the inlets/outlets.

To address this, in situations where the impeller drive shaft is free to rotate it is common practice to rotate the impeller as it is being inserted into the pump housing. However, this is typically impracticable when the impeller drive shaft is locked in a static position, as the impeller cannot, of course, be rotatable relative to its drive shaft. To address this problem in cases where the shaft is fixed, it is common to use an elongate tool, such a screw driver or the like, to manually bend the vanes so as to ease them past the various impediments to their insertion; this is clearly time-consuming and risks damaging the impeller and the inner surface of the pump housing.

The present invention addresses this by providing a mounting hub which permits the impeller to be decoupled rotationally from the impeller drive shaft during installation, and then recoupled rotationally once the flexible impeller is in position.

The mounting hub of the present invention comprises a drive shaft-engaging portion and an impeller body-engaging portion.

The drive shaft-engaging portion typically comprises an aperture located axially in the hub which, in use, engages with the drive shaft and rotationally locks the hub relative to the drive shaft.

The impeller body engaging portion typically comprises a suitably profiled portion on the outside of the hub which, in use, engages with the impeller body, and rotationally locks the hub relative to the impeller body.

Typically the hub is elongate, and the length of the hub suitably corresponds substantially to the full width of the impeller body.

The hub thus suitably comprises a tubular member which has a suitable cross-section such that the internal and external surfaces of the tubular member are adapted to engage with the drive shaft and the impeller, respectively, and rotationally lock them together. The internal surface defines the drive shaft-engaging portion and the outer surface defines the impeller body-engaging portion The impeller body engaging portion and the drive shaft engaging portion can take any suitable form adapted to engage with a corresponding portion on the drive shaft or impeller body. For example, the engaging portions can each be independently selected from, corresponding splines, corresponding key and slot arrangements, corresponding polygonal cross-sections, or any of the plethora of other well-known mechanical systems for rotationally coupling pairs of components. In the present case, 'corresponding' means that the portions can stably fit together to rotationally couple the hub to the impeller body or drive shaft.

In a preferred embodiment, the hub comprises an elongate member defining a polygonal profiled inner lumen and a polygonal profiled outer surface.

Suitably the inner lumen profile and the outer profile are generally triangular in cross section.

In a preferred form the cross sections of inner and outer profiles of the hub are substantially truncated equilateral triangles. A suitable form of such a cross section can be defined as a 'tri-lobe' arrangement, wherein the profile is defined by three circular arcs, where each arc is connected by a chord, with a rotational symmetry of 120 degrees. Such a form is sometimes referred to as a 'three flat' drive shaft coupling.

An advantage of a polygonal profile, in particular a tri-lobe profile, is that it is self-centring, which means that concentric alignment of the shaft and impeller is assured. As such problems with eccentric running of the shaft and the impeller can be avoided.

In some embodiments the hub is tapered along its length to facilitate insertion of the hub, and to provide centring of the impeller relative to the drive shaft as the hub is inserted.

Such a hub arrangement makes fitting a flexible impeller to the shaft easier than conventional methods, where the impeller is mounted directly to the shaft and is splined or keyed such that the shaft and impeller move as one. Fitting and removal of the impeller can often be problematic where prising the impeller can lead to damage of the impeller, the shaft and often the housing.

The mounting hub may be moulded or otherwise manufactured from corrosion resistant material, for example plastic.

The drive shaft-engaging portion and impeller body-engaging portion may be moulded or otherwise manufactured from corrosion resistant material, for example plastic.

Alternatively, one or both of the drive shaft-engaging portion and impeller body-engaging portion may be moulded or manufactured from a corrosion resistant metal or metal alloy.

The single or twin cam flexible impeller pump of the second aspect of the invention may suitably comprise a mounting hub in accordance with the third aspect of the present invention.

Suitably the hub is adapted to be secured to the impeller and/or the drive shaft to prevent relative axial movement between the hub and/or drive shaft using a suitable fixing means. For example the fixing means can comprise a pin, peg, catch, bolt, lock-ring, c-clip or the like, and the hub can comprise a suitable aperture, slot, groove, catch, thread or the like to facilitate or permit securing of the hub to the impeller and/or shaft. In a preferred embodiment the impeller body comprises an annular groove adapted to receive a sprig clip such as a circlip or snap ring which acts to secure the hub relative to the impeller.

Suitably the hub comprises an extraction means (e.g. an interface) to assist in extraction of the hub, and more preferably of the hub and the impeller simultaneously. When the hub is axially secured to the impeller, extraction of the hub will conveniently result in removal of the impeller. The extraction means suitably comprises any means which is adapted to permit engagement with an extraction tool, such as a puller, to permit the hub to be pulled of the drive shaft. The extraction means can suitably comprise at least one threaded aperture, a groove, notch or suchlike, with which an extraction tool can engage. In a preferred embodiment the extraction means comprises a plurality (preferably three) circumferentially spaced threaded bores (preferably one bore in each lobe of a tri-lobed mounting hub), which are adapted to engage corresponding bolts on an extraction tool, such as a puller.

Being able to remove the hub and impeller simultaneously is advantageously as it means that removal of the hub and the impeller can be achieved using only a single tool, and in a single operation. This combined with the benefits of the hub in terms of simplicity of installation of the impeller provides a remarkable convenient system for a user.

In a fourth aspect the present invention provides a method of installing a flexible impeller into a flexible impeller pump housing, the method comprising:

a) providing a flexible impeller;
b) providing a flexible impeller pump housing having disposed therein a drive shaft for the flexible impeller;
c) inserting the flexible impeller into the pump housing, preferably using a rotating action to facilitate insertion impeller; and
d) inserting a hub according to the third aspect of the invention, the hub acting to rotationally lock the flexible impeller relative to the drive shaft.

Details of the hub are set out above.

Suitably the drive shaft is rotationally static during the flexible impeller installation procedure.

Suitably the method comprises engaging a fitting tool with the impeller body, and using the fitting tool to rotate the impeller during insertion into the pump housing.

The method suitably comprises securing the hub in position using a fixing means. The fixing means can be, for example, a pin, peg, catch, bolt, lock-ring, c-clip or the like.

The hub can be secured to the shaft and/or to the flexible impeller.

Alternatively, thought less preferably, the hub can be retained in position by friction, or by a housing cover or a spacer between the hub and the housing or suchlike.

Suitably the method further comprised installing a housing cover, and optionally any associated seals or gaskets or the like, to seal the pump housing.

It will be apparent that the flexible impeller in this aspect is adapted to engage with the hub, and thus has a corresponding internal profile. Furthermore, it will be apparent that the flexible impeller is free to rotate relative to the drive shaft prior to insertion of the hub.

In a further aspect the present invention provides a method of extracting an impeller mounted on a drive shaft via a mounting hub as set out above from a pump housing, the method comprising the steps of:

engaging an extraction tool with an extraction means provided on the hub;

operating the extraction tool to extract the hub from the drive shaft;

thereby extracting the impeller from the housing.

Preferably the impeller is secured to the hub by a fixing means, as described above. However, in some cases a fixing means may not be required, e.g. when there is sufficient friction between the hub and the impeller.

Suitably the method comprises disengaging a fixing means securing the hub to the drive shaft, if such a fixing means is present The method of extraction is suitably carried out subsequent to the method of installation mentioned above.

In a further aspect the present invention comprises an impeller assembly, the impeller assembly comprising a flexible impeller and a hub according to the third aspect of the invention. The flexible impeller can be a flexible impeller according to the first aspect of the present invention, or it may be a conventional flexible impeller.

In a further aspect the present invention provides a flexible impeller pump comprising a flexible impeller mounted on a drive shaft within a pump housing, wherein a hub according to the third aspect of the invention is provided to rotationally couple the flexible impeller to a drive shaft.

BRIEF DESCRIPTION OF THE DRAWINGS

Embodiments of the present invention are described below, by way of example only, with reference to the accompanying drawings, in which.

DESCRIPTION OF AN EMBODIMENT

Figure 1:
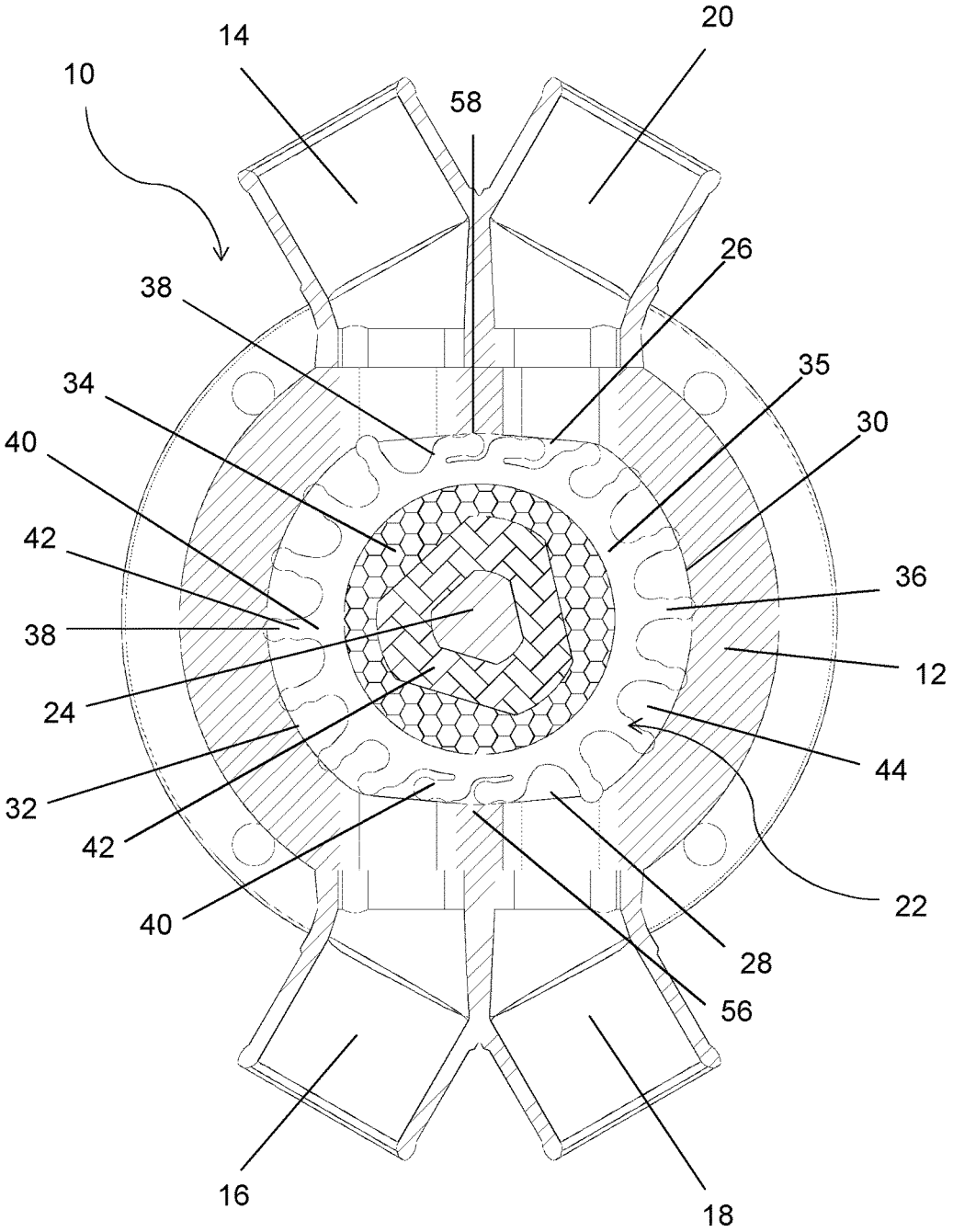
FIG. 1 is a schematic representation of a flexible impeller pump according to an embodiment of the present invention.

FIG. 1 shows a dual cam flexible impeller pump 10 according to an exemplary embodiment of the present invention. The flexible impeller pump 10 comprises a pump housing 12, having a first inlet 14, a first outlet 16, and second inlet 18, and a second outlet 20. The pump comprises a flexible impeller 22, which is rotatably mounted in the pump housing 12 on an impeller drive shaft 24.

The housing comprises cammed surfaces (also referred to as cams) 26 and 28, and cylindrical inner surfaces 30 and 32.

The impeller 22 comprises a body portion 34,35 from witch a plurality of vanes 36 extend outwards, extending radially when adjacent to the cylindrical surface of the housing, and deflected into a bent configuration when in contact with the cammed surfaces. Each vane comprises a tip 38, a root 40 and a stem 41 extending between the root and this tip. An inter-vane volume 44 is defined by the trough between a vane and the adjacent vane, in which the fluid being pumped is held as it moves between the inlet and the outlet. The tip 38 of each vane 36 includes a bulbous sealing element, which is provided by an enlarged portion at the tip. In the illustrated embodiment the enlarged portion has a generally circular cross-section and acts to provide a seal between the vane and the inner surface of the housing 12. The sealing function provided by the tip of each vane performs two functions: firstly, it provides a seal against the pump housing to enable the pumping vanes to force the fluid from the first inlet to the first outlet, where it is squeezed into the outlet by the cam, and, secondly, it ensures separation of the first inlet and second outlet and second inlet and first outlet when the vanes are deflected by contact with the cammed surfaces, to prevent slippage of fluid from the outlet to the inlet past the cam surfaces.

In the present case the body of the impeller comprises a two piece body, which comprises as outer body 35 and an inner body 34 (which is shown in honeycomb hatching in FIG. 1). The outer body 35 is formed from an elastomeric material, such as natural rubber, neoprene or the like; this is typically the same material as the vanes, and the vanes and the outer body are contiguous with the outer body. The inner body 34 is formed of a plastics material, such as high density polyethylene or the like. Such a construction of impeller is preferred as it allows the elastomeric vanes and outer body to be mounded onto a comparatively rigid inner body. The inner body provides a suitable substrate for the moulding process, and allows for the moulded article to be readily removed from the housing. It will be apparent to the skilled person that other forms of flexible impeller are possible, e.g. where the entire impeller is formed from a flexible, elastomeric material.

The flexible impeller is mounted on a mounting hub 42, which in turn is mounted on the drive shaft 24. As can be seen, the hub comprises a tri-lobed form, wherein the inner and outer profiles of the hub are defined by three circular arcs 56 where each arc 60 is connected by a chord 62. The inner profile of the impeller has a corresponding inner profile, and the drive shaft has a corresponding outer profile. Accordingly, the shaft, hub and impeller are rotationally coupled together by the corresponding profiles.

A cover plate (not illustrated) is, of course, fitted to the outside of the housing to seal the impeller housing.

Figure 2:
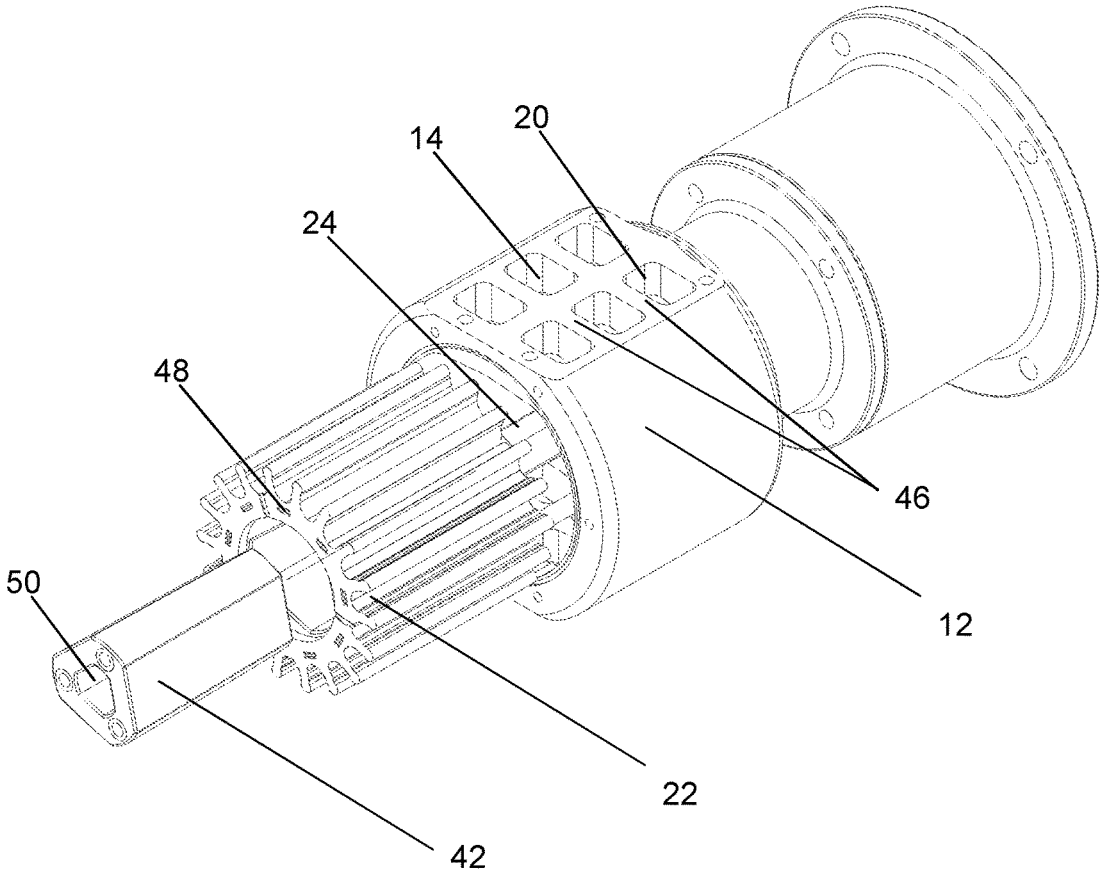
FIG. 2 is an exploded perspective view of a flexible impeller pump according to an embodiment of the present invention.

FIG. 2 shows an exploded view of a flexible impeller pump according to the present invention.

The ports in the housing 12 from the first inlet 14 and second outlet 20 can be seen. From this view circumferential support ribs 46 provided in the inlets and outlets can be clearly seen.

The impeller 22 is shown adjacent to the housing 12. Slots 48 can be seen on the end of the impeller, which are residuals from the injection moulding technique. The internal tri-lobe profile can be engaged by a fitting tool (not shown) during installation of the impeller in the housing. The tool is used to rotate the impeller as it is inserted, which advantageously allows for the vanes to be manoeuvred past the various impediments which the vanes abut against during insertion. For example, the vanes typically abut against the outer rim of the housing and the circumferential support ribs 46.

The hub 42 is shown, and its tri-lobe tubular form can be clearly seen. The central lumen 50 can be clearly seen, and, again, the tri-lobe profile can be seen. The hub 42 acts to rotationally lock the impeller 22 to the drive shaft 24. When the hub 42 is not in position, the impeller is free to rotate relative to the drive shaft. This allows for the impeller to be rotated when it is inserted into the housing, even where the drive shaft is rotationally locked in position. When the impeller is fully inserted, it is rotated to an appropriate point where the profiles of the drive shaft and the impeller are appropriately aligned, and the hub is inserted to rotationally couple the impeller and drive shaft together. The impeller comprises three threaded apertures 66 (best seen in FIG. 5) which provide an interface (extraction means) which is particularly useful during extraction of the hub, as described below.

Figure 3:
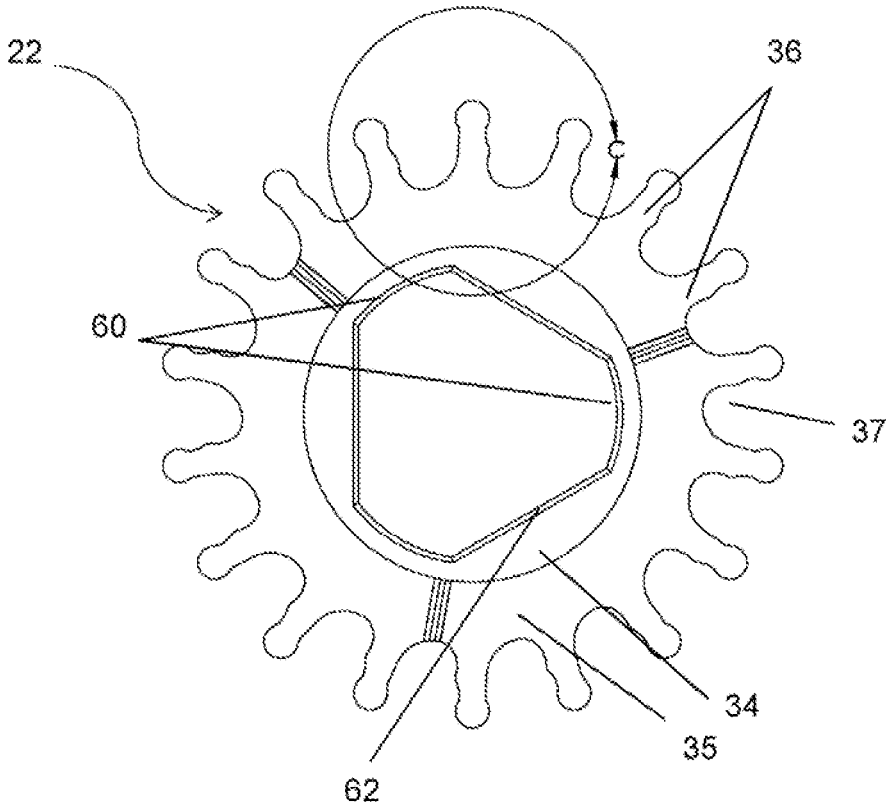
FIG. 3 is a schematic representation of a flexible impeller according to the present invention.
Figure 4:
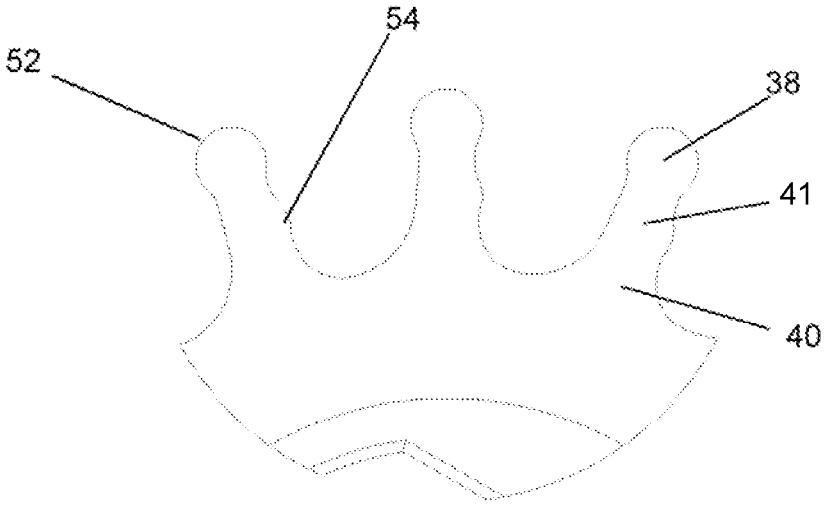
FIG. 4 is a schematic detail view of three vanes of the impeller of FIG. 2.

FIGS. 3 and 4 show cross-sections of the impeller 22 and the vanes, in particular, in more detail. FIG. 3 shows a cross section of the impeller, and FIG. 4 shows the area marked 'c' in close up.

Each vane comprises a tip 38, a root 40 and a stem 41 extending between the root and this tip. Between adjacent vanes 36 there is a trough 37, which defines and inter-vane volume. The tip of the vane defines a first sealing element 52. In the present embodiment the first sealing element is in the form of a bulbous portion, having a partial circular cross-section. In other words, the profile of the vane at the tip expands to form a portion of generally circular cross-section. This bulbous profile extends along the entire length of the vane. A second sealing element 54 is provided at about the midpoint of the vane, i.e. equidistant between the root and the tip of the vane. The second sealing element is defined by a bulbous protrusion from the leading side of the vane (the right side in the Figure). As can be seen, the protrusion has a cross-section of partial outer diameter of a circle—the illustrated protrusion forms a convex protrusion being an arc of about 90 degrees.

Referring back to FIG. 1, it can be seen that when the vane is passing around the cylindrical inner surface of the housing, the first sealing element located at the tip of the vane is in a sealing engagement with the inner surface of the housing. The vanes at this point are referred to as pumping vanes, and they are only very slightly bent. When the vanes meet the cammed surfaces 26,28 the vanes are deflected and bent, and both the first sealing element and second sealing element engage with the cammed surface. Between each inlet and outlet at a cammed 26,28 surface, there is a cammed sealing surface 56,58. As the vanes pass across the cammed surface from an outlet to an inlet, the deflected vanes maintain a seal to isolate the inlet form the outlet. Where each vane provides only a single sealing element, the cammed sealing surface must be large enough to accommodate the single sealing element of two vanes such that there is at least one deflected vane providing a seal between the inlet and outlet. It will be appreciated that through the addition of the second sealing element between the root and tip of the blade the length of the cammed sealing surface can be greatly reduced. Correspondingly the overall length of the cammed surface can be reduced allowing the length of each cylindrical inner surface 30, 32 to be increased. By increasing the length of the cylindrical inner surfaces in this manner the number of utilised pumping vanes can be maximised whilst minimising the overall impeller diameter required.

Describing the operation of the pump, the impeller rotates and fluid is drawn in through the first inlet 14. The fluid is then carried around by the impeller in the inter-vane volume 44 between the vanes, and the fluid is retained by the sealing engagement between the vane and the housing surface. When the vanes reach the cammed surface of the first outlet 16, the cammed surface deflects the vanes and displaces the fluid, and the fluid is expelled through the outlet. It will be appreciated that, in order to do useful work, a pump must generate pressure/head at its outlet and the amount of pressure/head generated is of critical importance in selecting a pump for an application. As the pump is working the pressure/head applies a resultant force against the pumping vanes upstream of the cammed surface. This force is opposed by all of the upstream pumping vanes and their associated sealing elements, and the more pumping vanes between the outlet and the inlet, the better the pump is able to prevent slippage, i.e. leaking of fluid past the vanes back to the inlet port. While it is possible to improve sealing by, for example, forcing the pumping vanes against the inner housing surface with more force, this increases running friction, increasing energy consumption and wear. Shortening the vanes also allows the vanes to more effectively resist back pressure, but the vanes must have a suitable length to pass the cammed surface, and maintain an appropriate pumping capacity. Vanes made of stiffer materials can also better resist back pressure, but stiffer vanes wear more quickly and are less able to deflect at the cammed surface. Thus, it is desirable to maximise the number of pumping vanes available to resist this back pressure. In the embodiment of FIG. 1, it can be seen that there are 5-6 pumping vanes. If the vanes did not have the dual sealing elements, it would be necessary to have larger cammed sealing area, which would necessitate a reduction of the number of pumping vanes to 3-4. While this may not seem dramatic, the result of such a reduction in the number of pumping vanes would cause a significant reduction of the pressure/head the pump can generate, and consequently an increase in slippage.

Installation of an impeller into the housing, e.g. during routine maintenance, is performed as follows. The impeller is brought into position to be inserted into the housing. A fitting tool is connected to the impeller. The impeller is then pushed into the housing whilst being rotated via the fitting tool. Rotation is facilitated because the impeller is free to rotate about the drive shaft. This rotation eases the vanes into the housing, and allows the foremost edge of the vanes to be urged past various impediments to insertion such as the edge of the housing (in particular the cammed surfaces), the edges of the inlets and outlets, and the circumferential support ribs present in the outlets. Once the impeller is fully inserted into the housing, the impeller is rotated until it is correctly aligned with the drive shaft and the fitting tool is disengaged; correct alignment occurs three times per revolution with the profiles illustrated. The hub is then inserted to rotationally couple the impeller to the drive shaft. Retainers such as c-clips or the like can then fitted to lock the hub to the shaft and to lock the impeller to the hub. The housing cover is then fitted to seal the housing.

Suitable materials for the construction of the various components of a pump according to the present invention will be apparent to the skilled person. Typically the impeller will be formed from a resilient polymeric material, such as a natural or synthetic elastomer, e.g. natural rubber, nitrile rubber, or neoprene. The pump housing will typically be constructed from metal, e.g. a bronze or aluminium alloy, or stainless steel. The drive shaft is typically constructed from stainless steel, but other known drive shaft materials can be used, such as steel or aluminium. The impeller body typically is formed from a metal, such as a bronze or aluminium alloy, or from a strong plastics material such a glass reinforced plastic, HDPE or the like.

The pump housing may comprise a lining, e.g. a lining formed from plastics material. The lining defines the sealing surface against which the vanes of the flexible impeller press to form a sealing engagement. Such a lining can advantageously be produced from a polymer having a low coefficient of friction, therefore reducing friction between the impeller and the sealing surface of the housing compared to a metal surface. Furthermore, such a lining can allow convenient replacement of the lining when it becomes worn.

The lining is typically substantially cylindrical, having apertures corresponding to the inlets and outlets provided in the housing.

Figure 5:
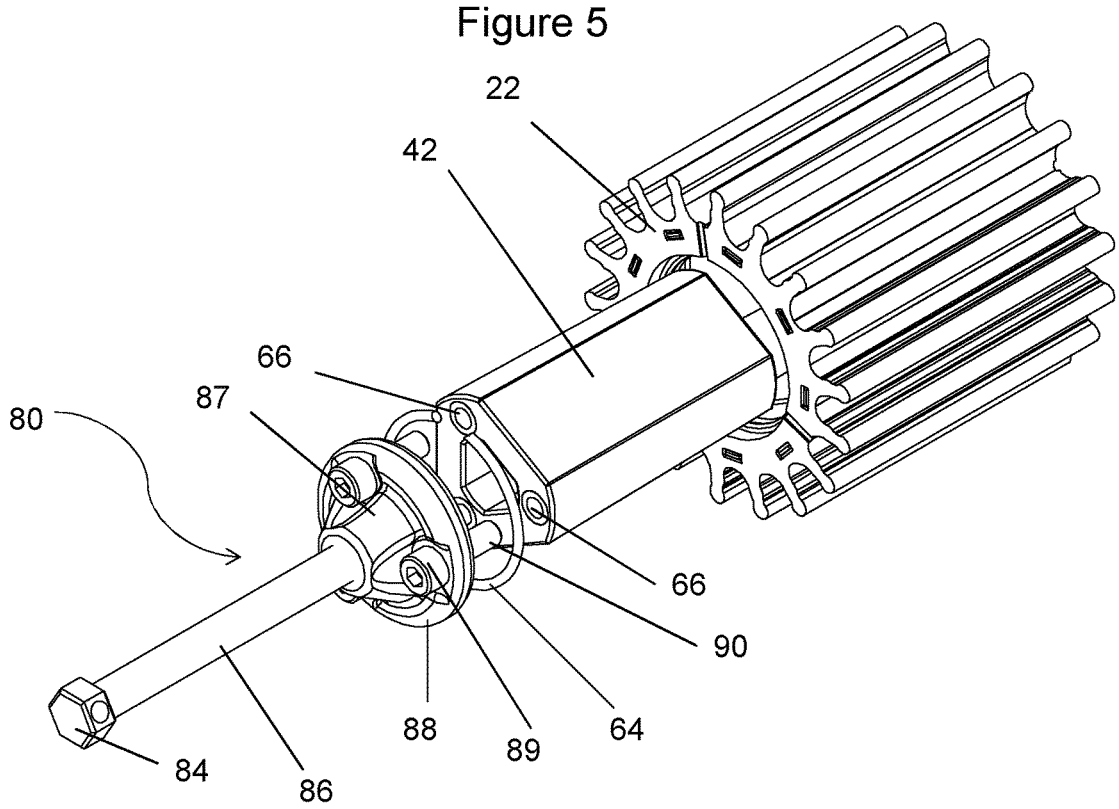
FIG. 5 is an exploded perspective view of a flexible impeller, hub and extraction tool according to the present invention.
Figure 6:
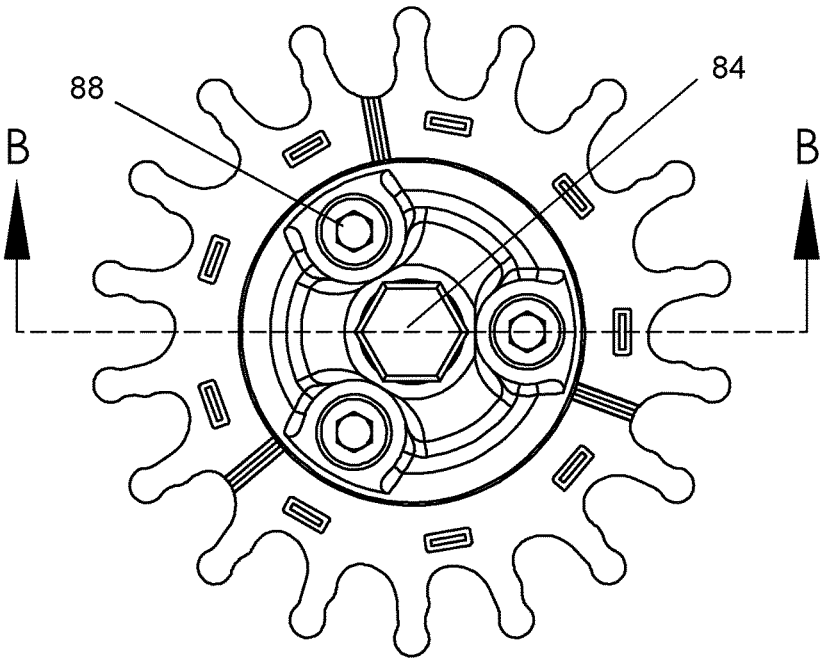
FIG. 6 is an end view of the flexible impeller, hub and extraction tool.

FIG. 5 shows an impeller 22, along with a hub 42, which cooperates to mount and rotationally lock the impeller on a drive shaft. When the hub is inserted into the impeller, a snap ring 64 mounts in an annular groove on the impeller, and axially secures the hub within the lumen of the impeller. This allows for both a secure assembly, and for the hub to be used to assist in extraction of the impeller, as will be described below.

An extraction tool 80, for use in extracting the impeller is shown. It comprises a shaft 86, with a hex head 84 at the distal end. At the proximal end of the shaft there is mounted a body 87 having a circular flange 88. The head comprises a threaded central aperture which is mounted on a treaded portion of the shaft, such that rotation of the shaft relative to the body results in relative axial movement of the body relative to the body. Three bolts 89 are rotatably mounted in the flange, and they are evenly spaced circumferentially (120 degrees apart). The threaded portion 90 of these bolts are adapted to engage with three corresponding threaded apertures 66 provided in the hub (this defines an extraction means or interface in the hub). Thus, when the bolts are screwed into the apertures in the hub, the hub and body 87 are secured together.

Figure 7:
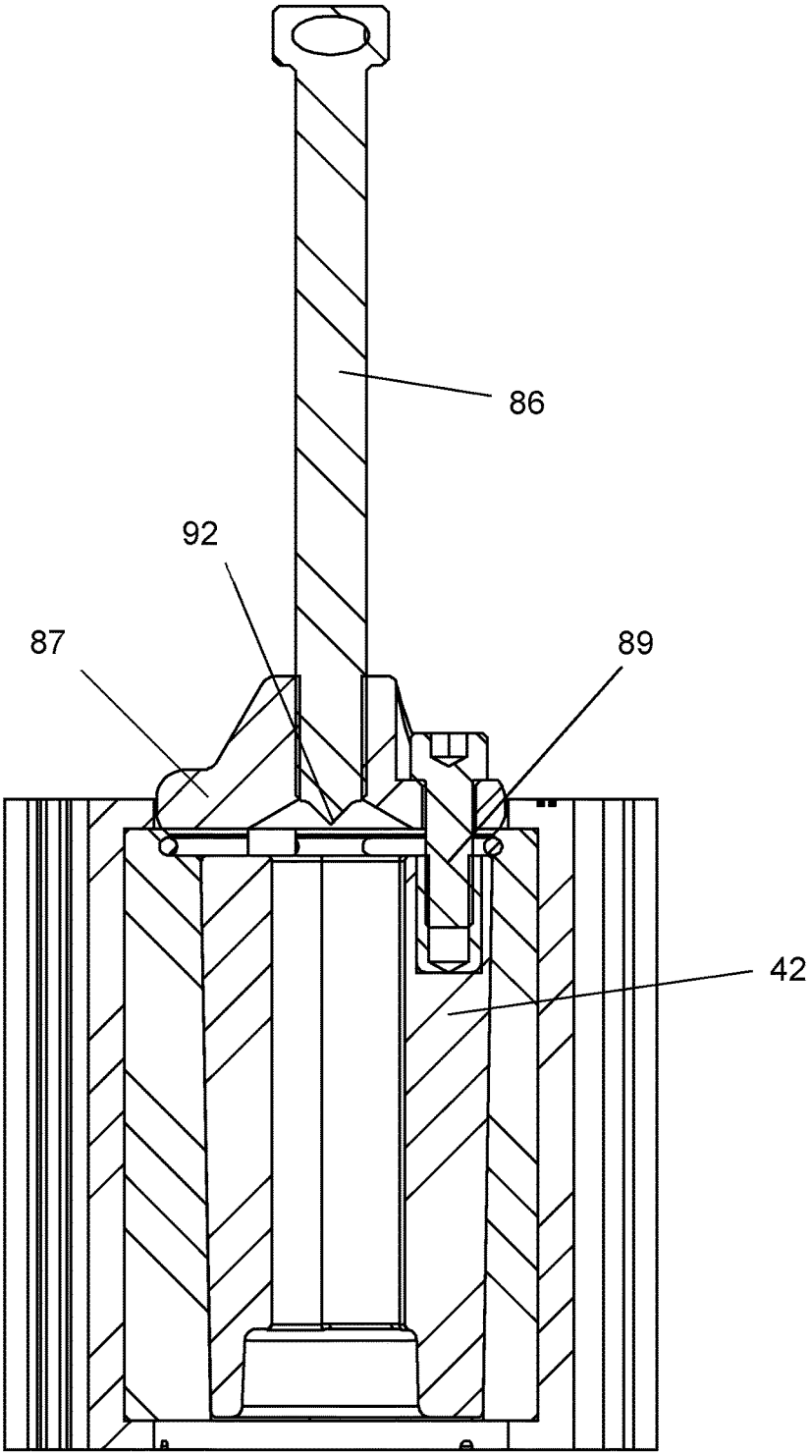
FIG. 7 is a cross-section view through line B-B of FIG. 6.

As best seen in FIG. 7, rotation of the shaft, which can be readily achieved using a suitable hex driver such as a spanner (wrench) or socket, results in movement of the tip 92 of the shaft 86 toward (clockwise rotation) or away (anti-clockwise rotation) from the drive shaft of the pump (not shown in this figure). As will be apparent to the skilled man, once the tip 92 of the shaft is brought into abutment with the drive shaft, continued clockwise rotation of the shaft will result in the hub been drawn (pulled) off the drive shaft. Because distal movement of the hub relative to the impeller is prevented\limited by the snap ring 64, the impeller will consequently also be pulled in a distal direction as the hub is moved. Thus, the shaft 92 can be rotated until the hub and impeller are pulled together from the drive shaft and pump housing.

Whilst specific embodiments of the present invention have been described above, it will be appreciated that departures from the described embodiments may still fall within the scope of the present invention. For example, as mentioned above, the tri-lobed profiles of the hub and shaft/impeller can be replaced with another profile, such a spline or the like. Furthermore, the hub profile for engagement with the shaft need not be the same as the profile for the impeller—the important thing is that suitable profiles are selected which allow the impeller to be rotated independently of the shaft, and then be coupled to the shaft by the hub. The first and/or second sealing profiles could be defined by, for example, a blade profile, which has one or more sealing lips, or by any other protrusion. The impeller can be adapted for reversible operation, i.e. by providing a second sealing element on both sides of the vanes.

The invention claimed is:

1. A mounting hub operable to connect a flexible impeller to, and support the impeller upon, a drive shaft;

wherein, in use, the mounting hub supports the impeller for rotational movement upon the drive shaft;

wherein the mounting hub is detachable from the impeller;

wherein further the mounting hub is adapted to permit the impeller to be completely decoupled for rotational movement from the drive shaft during installation, and then recoupled to the drive shaft for rotational movement once the flexible impeller is in position;

wherein the mounting hub comprises a drive shaft-engaging portion and an impeller body-engaging portion, the drive shaft-engaging portion having an aperture located axially in the mounting hub which, in use, engages with the drive shaft and rotationally locks the mounting hub relative to the drive shaft, and the impeller body-engaging portion comprising a non-circular profiled portion on an outside of the mounting hub which, in use, engages with the impeller and rotationally locks the mounting hub relative to the impeller;

wherein the mounting hub comprises a tubular member having a cross-section such that surfaces of the drive shaft-engaging portion and the impeller body-engaging portion are adapted to directly engage with the drive shaft and the impeller, respectively, and rotationally lock them together; and wherein further the mounting hub is tapered along its length to facilitate insertion of the mounting hub, and to provide centering of the impeller relative to the drive shaft as the mounting hub is inserted.

2. The mounting hub of claim 1, wherein the mounting hub is elongate and a length of the hub in the direction of the shaft corresponds substantially to a full width of an impeller body in the direction of the shaft.

3. The mounting hub of claim 1, wherein the impeller body engaging portion and the drive shaft engaging portion have polygonal cross-sections.

4. The mounting hub of claim 1, wherein the mounting hub comprises an elongate member, and wherein the drive shaft-engaging portion defines a polygonal profiled inner lumen and the impeller body-engaging portion defines a polygonal profiled outer surface.

5. The mounting hub of claim 4, wherein the polygonal profiled inner lumen and the polygonal profiled outer surface are substantially triangular in cross section.

6. The mounting hub of claim 5, wherein the polygonal profiled inner lumen and the polygonal profiled outer surface of the mounting hub are substantially truncated equilateral triangles.

7. The mounting hub of claim 1, wherein the mounting hub is adapted to be secured to the impeller and/or the drive shaft by a fixing means so as to prevent relative axial movement between the mounting hub and the impeller and/or drive shaft.

8. The mounting hub of claim 1, wherein the mounting hub comprises an extraction means to assist in extraction of the mounting hub.

9. A method comprising:

a) providing a flexible impeller;

b) providing a flexible impeller pump housing having disposed therein a drive shaft for the flexible impeller;

c) providing a mounting hub operable to connect the flexible impeller to, and to support the impeller upon, the drive shaft, wherein the mounting hub comprises a drive shaft-engaging portion having an aperture located axially in the mounting hub, and an impeller body-engaging portion comprising a non-circular profiled portion on an outside of the mounting hub, and wherein further the mounting hub is tapered along its length to facilitate insertion of the mounting hub, and to provide centering of the impeller relative to the drive shaft as the mounting hub is inserted;

d) inserting the flexible impeller into the pump housing; and e) inserting the mounting hub so that the aperture engages with the drive shaft and the impeller body-engaging portion of the mounting hub engages with the impeller to both support the flexible impeller upon and rotationally lock the flexible impeller relative to the drive shaft, wherein insertion of the mounting hub centers the impeller relative to the drive shaft, and wherein step e) occurs after step d);

wherein, in step d) the flexible impeller is rotationally decoupled from the drive shaft.

10. The method of claim 9, wherein the drive shaft is rotationally static during the method steps.

11. The method of claim 9, comprising securing the mounting hub in position using a fixing means.

12. A method comprising the steps of:

a) providing a pump housing having a flexible impeller supported upon an impeller drive shaft by a mounting hub including an impeller body-engaging portion comprising a non-circular profiled portion on an outside of the mounting hub which engages with the impeller to rotationally lock the mounting hub relative to the impeller, wherein the mounting hub is detachable from the impeller, wherein the mounting hub is adapted to permit the flexible impeller to be completely decoupled for rotational movement from the impeller drive shaft during installation of the flexible impeller and then recoupled to the drive shaft for rotational movement once the flexible impeller is in position, and wherein further the mounting hub is tapered along its length to facilitate insertion of the mounting hub, and to provide centering of the impeller relative to the drive shaft as the mounting hub is inserted;

b) engaging an extraction tool with an extraction means provided on the mounting hub;

c) operating the extraction tool to extract the mounting hub from the impeller drive shaft so that the flexible impeller is completely decoupled for rotational movement from the drive shaft; and d) thereby extracting the flexible impeller from the pump housing.

13. The method of claim 12, comprising disengaging a fixing means securing the mounting hub to the drive shaft.

14. An impeller assembly, the impeller assembly comprising a flexible impeller and a mounting hub operable to connect the flexible impeller to, and support the impeller upon, a drive shaft, wherein the mounting hub is detachable from the impeller so as to render the impeller rotationally decoupled from the drive shaft, and wherein the mounting hub comprises a drive shaft-engaging portion having an aperture located axially in the mounting hub which engages with the drive shaft and rotationally locks the mounting hub relative to the drive shaft, and an impeller body-engaging portion comprising a non-circular profiled portion on an outside of the mounting hub which engages with the impeller and rotationally locks the mounting hub relative to the impeller, and wherein further the mounting hub comprises a tubular member having a cross-section such that surfaces of the drive shaft-engaging portion and the impeller body-engaging portion are adapted to directly engage with the drive shaft and the impeller, respectively, and rotationally lock them together, and the mounting hub is tapered along its length to facilitate insertion of the mounting hub and to provide centering of the impeller relative to the drive shaft as the mounting hub is inserted.

15. The assembly of claim 14, wherein the flexible impeller comprises a body and a plurality of vanes extending outwardly from the body, wherein each vane comprises a root and a tip and at least two sealing elements.

* * * * *